US009556634B2

(12) United States Patent
Hosmer

(10) Patent No.: US 9,556,634 B2
(45) Date of Patent: Jan. 31, 2017

(54) GARAGE FLOOR BARRIER SYSTEM

(71) Applicant: Stephen L Hosmer, Minnetrista, MN (US)

(72) Inventor: Stephen L Hosmer, Minnetrista, MN (US)

( * ) Notice: Subject to any disclaimer, the term of this patent is extended or adjusted under 35 U.S.C. 154(b) by 0 days.

(21) Appl. No.: 14/739,616

(22) Filed: Jun. 15, 2015

(65) Prior Publication Data

US 2016/0032605 A1 Feb. 4, 2016

Related U.S. Application Data

(60) Provisional application No. 62/012,305, filed on Jun. 14, 2014.

(51) Int. Cl.

| | |
|---|---|
| ***E02B 7/02*** | (2006.01) |
| ***E04H 6/42*** | (2006.01) |
| ***E04F 15/16*** | (2006.01) |
| ***F21S 4/00*** | (2016.01) |
| *F21S 8/00* | (2006.01) |

(52) U.S. Cl.

CPC ..... *E04H 6/428* (2013.01); *F21S 4/003* (2013.01); *F21S 4/28* (2016.01); *F21S 8/032* (2013.01)

(58) Field of Classification Search

CPC ..... E04F 15/02166; E04F 15/02188; E04F 15/02172; E04F 19/02; E04H 6/428; F21S 4/20; F21S 8/03

USPC ..... 52/716.2, 718.04, 717.03

See application file for complete search history.

(56) References Cited

U.S. PATENT DOCUMENTS

| | | | | | |
|---|---|---|---|---|---|
| 2,297,887 | A * | 10/1942 | Hall | B60R 13/04 | 220/DIG. 3 |
| 3,052,248 | A * | 9/1962 | Reuter | E04H 6/428 | 134/199 |
| 3,451,709 | A * | 6/1969 | Swauger | B60R 13/04 | 248/345.1 |
| 4,265,064 | A * | 5/1981 | Parezo | E02D 31/02 | 52/169.14 |
| 4,804,570 | A * | 2/1989 | Bedics | A47L 23/24 | 15/217 |
| 5,013,596 | A * | 5/1991 | Kessler | E04F 19/026 | 24/293 |
| 5,058,843 | A * | 10/1991 | Koster | B60R 13/04 | 248/223.41 |
| 5,149,569 | A * | 9/1992 | McCue | A47B 95/043 | 24/297 |
| 6,183,104 | B1 * | 2/2001 | Ferrara | F21S 2/005 | 362/145 |
| 6,258,430 | B1 * | 7/2001 | Perlman | E04H 6/428 | 180/69.1 |
| 7,347,606 | B1 * | 3/2008 | Patten | F21V 15/013 | 362/152 |

(Continued)

*Primary Examiner* — Christine T Cajilig

(74) *Attorney, Agent, or Firm* — Geiser Law, PLLC; Greg N. Geiser

(57) ABSTRACT

A garage floor barrier system for installation onto a garage floor for segregating debris. The barrier system includes rail portions, connectors, and cover members. The rail portion includes a notch on a bottom side to aid in installation and provides a recess for the placement of adhesive during attachment. The connectors allow for corner, angle, and straight connection and are constructed in a shape and dimension allowing for flexion. The barrier system is installed continuous around a parked vehicle and allows a user to both contain and easily remove trapped debris.

17 Claims, 12 Drawing Sheets

(56) References Cited

U.S. PATENT DOCUMENTS

| | | | | |
|---|---|---|---|---|
| 7,430,978 | B2 * | 10/2008 | Rezzonico | B63B 59/02 114/219 |
| 8,939,419 | B2 * | 1/2015 | Wallace | B32B 7/02 248/345.1 |
| 9,074,332 | B1 * | 7/2015 | Matteson | E04H 6/428 |
| 2006/0032162 | A1 * | 2/2006 | Cooper | E04F 19/049 52/211 |
| 2010/0135020 | A1 * | 6/2010 | Moore | A47F 11/10 362/249.02 |

* cited by examiner

GARAGE FLOOR BARRIER SYSTEM

CROSS REFERENCE TO RELATED APPLICATIONS

This application claims priority to U.S. Provisional Patent Application No. 62/012,305 filed 14 Jun. 2014 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a barrier system for attachment to a garage floor with the purpose of segregating debris fallen from a parked vehicle.

BACKGROUND OF THE INVENTION

Often in cold and wet climates, debris such as snow, ice, mud, water, slush, gravel, dirt, and road grime collect on the bottom of vehicles. When these vehicles are parked into a garage or other similar structure, this debris accumulates onto the floor of these structures. Especially as ice and slush melt into liquid form, debris drops from the vehicle and spreads out into the surrounds of the structure. This accumulating debris that is not contained under the vehicle and is dispersed across the floor of the garage or other similar structure may then be carried or tracked into the structure or vehicle on the footwear of people or the feet of animals traveling through or within the structure.

Typically, this debris is physically removed by using a broom, squeegee or pressure washer. This removal can be time consuming and can exacerbate the spread of debris across areas that are desired to be kept clean or that are otherwise not impacted with debris. If the flooring surface is uneven, the movement of debris into unwanted areas is facilitated even further.

To combat this problem, U.S. Pat. No. 3,052,248 discloses a barrier device for isolating an area of a parking space within in a garage. This barrier system includes a flat bottom for attachment to a surface with a hollow interior and orifices that allow for the flow of water to flush the isolated area of debris. This flat bottom can provide for a cumbersome install and these orifices additionally allow for the flow of debris into the interior of the device when positive pressure is not applied.

Additionally, U.S. Pat. No. 5,308,670 discloses a large pad for placement underneath a vehicle. This pad can then be rinsed to remove the debris. This configuration has many disadvantages, including its size, its inability to be customized to a given space, its propensity to develop holes which leak liquid debris, the necessity for separate storage space during non-winter months to avoid mold and mildew accumulation under the tray, and the necessity to remove the tray from within the space to adequately clear the debris that accumulates under this tray. Therefore, there is a need for an improved barrier system to trap and segregate debris for easy removal. Preferably, this barrier system is easily installed, provides for customization, and is height adjustable.

SUMMARY OF THE INVENTION

A garage floor barrier system for trapping debris is disclosed. The barrier system, in particular, is designed to trap within its interior perimeter debris such as ice, snow, mud, slush, water, salt, road grime and other similar substances and segregate this debris from its exterior perimeter. The barrier system comprises a plurality of uniformly configured rail portions that are connected together to each other with a plurality of connectors to form a contiguous barrier which may be open to the exterior vehicle doorway of the structure and defining the interior and exterior of the barrier system or, alternatively, the barrier system may be in a closed configuration where an existing floor drain may be located within the enclosure and carry off the debris from the interior of the barrier system.

Each rail portion has a top side, a bottom side, and opposed sidewalls defining a hollow interior. The top side includes an anti-skid portion, the anti skid portion providing a gripping surface to create friction and prevent slippage if the surface is contacted by a user. In the preferred embodiment of the present invention, this anti-skid portion is a series of raised ridges. These ridges form a smaller contact surface creating greater grip pressure and allow debris to fall into the valley of the ridges.

The top side extends beyond its connection to the sidewalls, with this extension creating a lip portion. The lip portion is angular extending downward from the top side to the connection with the sidewall. This lip portion forms an attachment surface allowing for the attachment of a cover member. The cover member can easily be installed onto the top side by grasping the lip portion. The cover member can be used to raise the height of the barrier system to trap additional debris, create a mounting channel for the installation of small lights, allow for customization of colors, or be installed in specific locations along the perimeter to aid in ingress and egress of a vehicle as in a stepping platform or ramp to aid in the movement of heavy equipment over the height of the barrier.

The bottom side contacts the surface of the floor and provides resting support for the rail portion. In cross section, the bottom side includes a notch, the notch sized to receive an installation aid adhered onto the surface of the floor. Accordingly, the opposed sides of the notch will straddle the installation aid and allow the user to install the barrier system in the appropriate location by aligning the notch with the installation aid. Preferably the installation aid is an adhesive backed foam raised tape, although similar materials and mechanisms may be used.

The opposed side walls are in communication with the top side and bottom side and form the sides of the barrier system. The side walls extend downward from the top side and, in conjunction with the local floor surface, form a recess. The recess is created from an outcropping of the sidewall and defining a height from a lower portion of the outcropping to the floor the barrier system is installed on. The height of the recess corresponding to an appropriate bead size of adhesive applied to secure the barrier system to the floor, wherein the adhesive is applied using a standard or commercial sized caulking tube and tip. Accordingly, the configuration of the barrier system side wall provides for this recess on both the interior and exterior of the barrier system allowing for a double seal and adhesive placement, wherein both sides of the rail portion are secured to the floor. The outcropping further provides added stability in the case of uneven floors where the rail may not sit flush on the ground for its entire length, wherein the outcropping provides lifting support for the rail portion in conjunction with the adhesive and the outcropping directs additional adhesive into any recess between the bottom of the barrier system rail and an uneven floor as it is applied.

Preferably, the adhesive used to secure the rail portions and barrier system to the floor is water penetrating adhesive to allow for installation on a damp surface. Although, this is the preferred adhesive type, there are other adhesive types that may be used to secure the system to the floor.

The connectors are configured to attach adjacent sections of rail portion by fitting a connector end portion into the hollow rail portion. Accordingly, the connectors have ends sized and configured to the hollow interior of the rail portion for insertion during assembly. The connector ends are intentionally undersized to allow for angle variations during installation. The connectors are preferably constructed out of a durable plastic or rubber material and provided in varying configurations to allow for customization during installation. Preferably, three main configurations are utilized: a corner connector, a straight connector, and an angled connector. The corner connector is provided to form the corners of the barrier system and utilized to create a near 90 degree bend in the assembly. The straight connector is provided to attach two sections approximately inline with each other end to end. The angled connector is utilized to extend the barrier system outward from an area around the vehicle to an area adjacent to the garage opening, completing the perimeter around the three sides of the vehicle wherein the angled connector allows for a narrow width around the vehicle and wide width at the garage opening. Alternatively, in spaces that have a floor drain, the barrier system may be installed as an enclosed barrier system allowing liquid debris to be contained within the perimeter and moved to the floor drain.

To install the garage floor barrier system the user will clean the designated area to remove any oils, dirt, and debris, and in the case of bare concrete floors, will roughen the surface of the concrete by grinding or sanding to create a texture suitable for attachment by the adhesive. The user will then dry fit the barrier system within the designated area to ensure proper alignment. The user may then place the installation aid on the flooring surface in the proper location and along the perimeter of the barrier system. The installation aid does not need to be laid continuous but can be laid periodically to ensure proper alignment. The rail portion and connectors are then assembled in place by using the installation aid to ensure a proper fit. This is accomplished by placing the notch of the rail portion side around the installation aid, wherein the installation aid nests between the notch and ensures a precise location of the rail portion and barrier system.

After the barrier system is assembled in the proper location, the user will then place an adhesive bead within the recess of the rail portion along the barrier system interior and exterior side walls sealing the interior and exterior perimeters. This ensures that the barrier system is water tight and secured to the flooring surface with the pair of recesses allowing for a double seal. Upon completion of the installation, debris is trapped within the interior perimeter of the structure and removed from within the barrier system by using a broom, squeegee, pressure washer, vacuum or other similar device to move the debris to the exterior of the structure or to a central point for drainage or pick-up.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
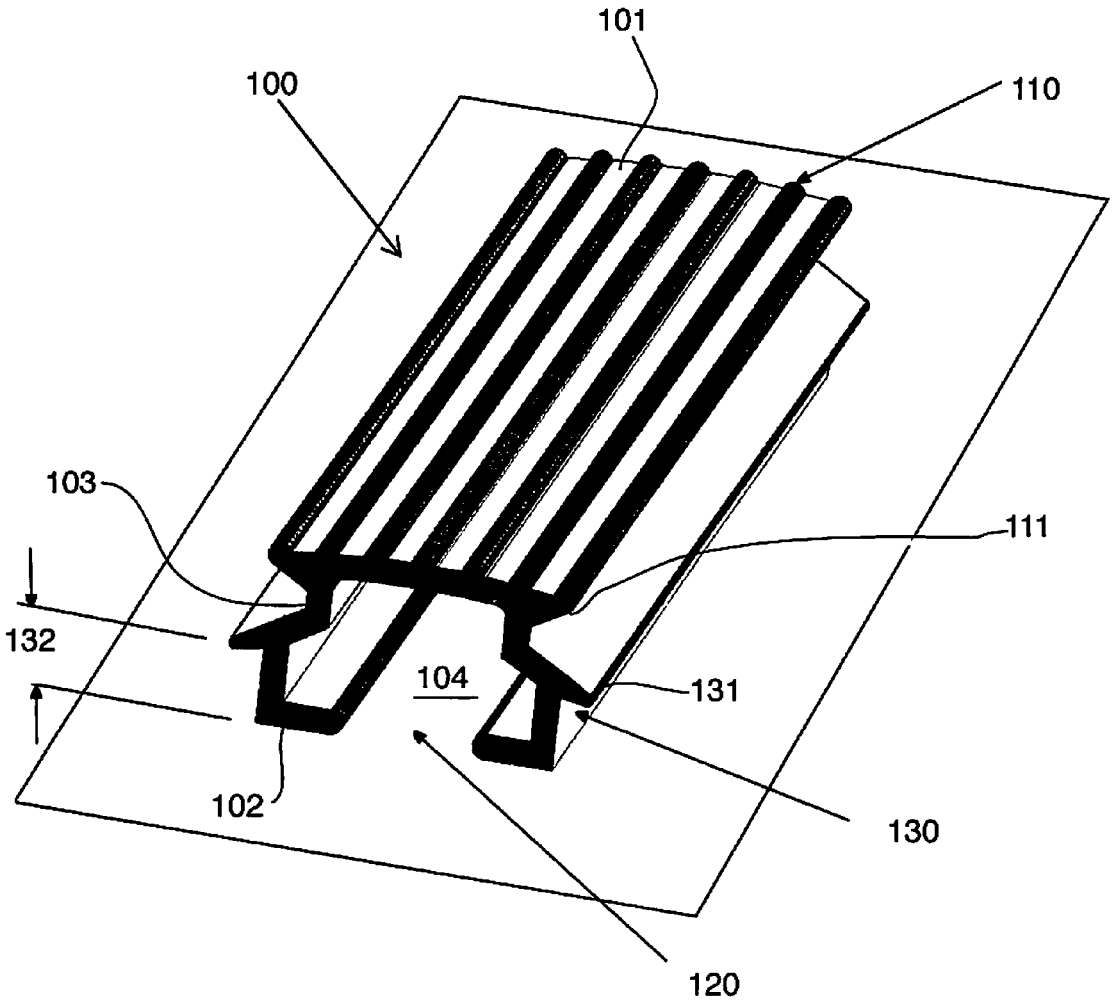
FIG. 1 is an isometric view of a rail portion of the barrier system, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus.

These terms are not meant to limit the elements that they describe, as the various elements may be oriented differently in various applications.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
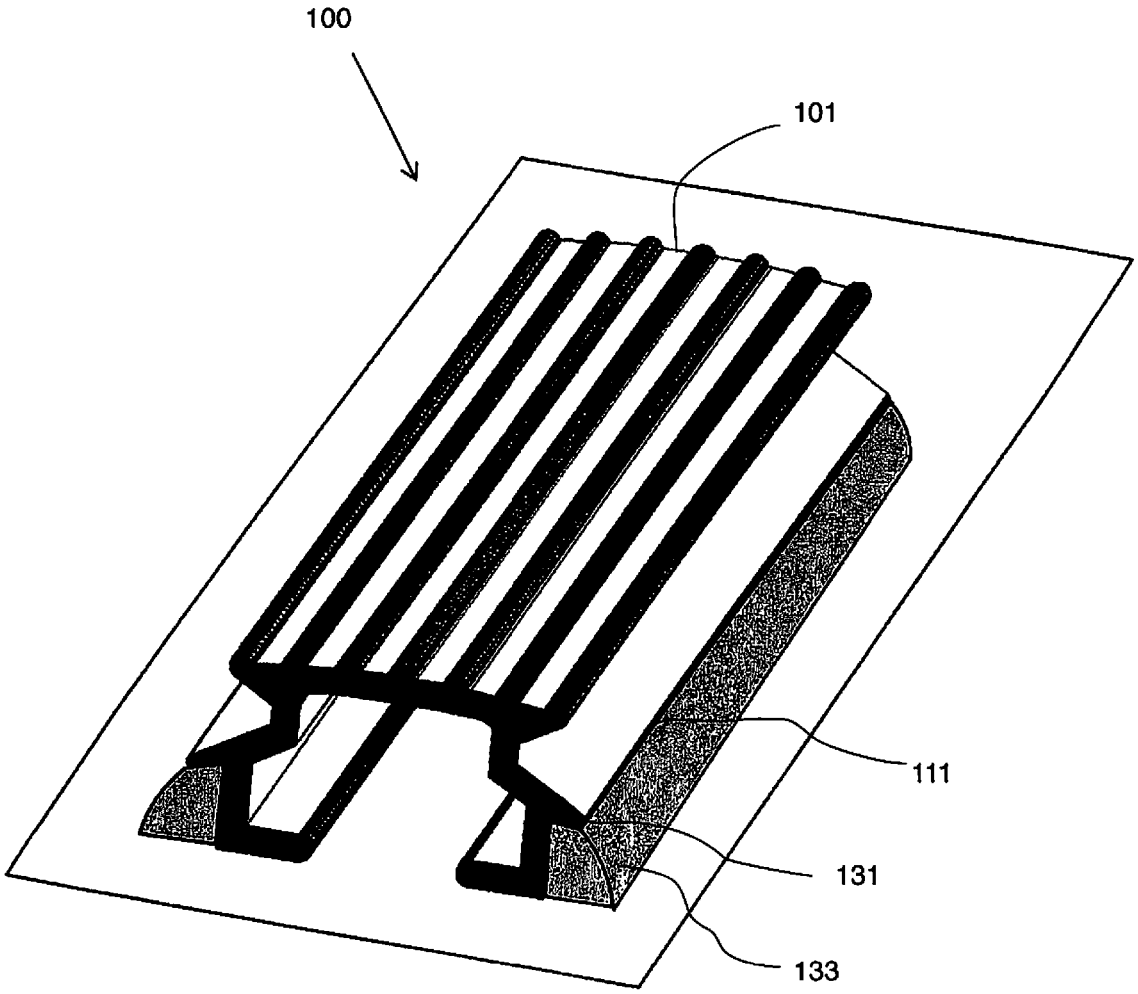
FIG. 2 is an isometric view of a rail portion of the barrier system with installation of the adhesive, according to the present invention.
Figure 3:
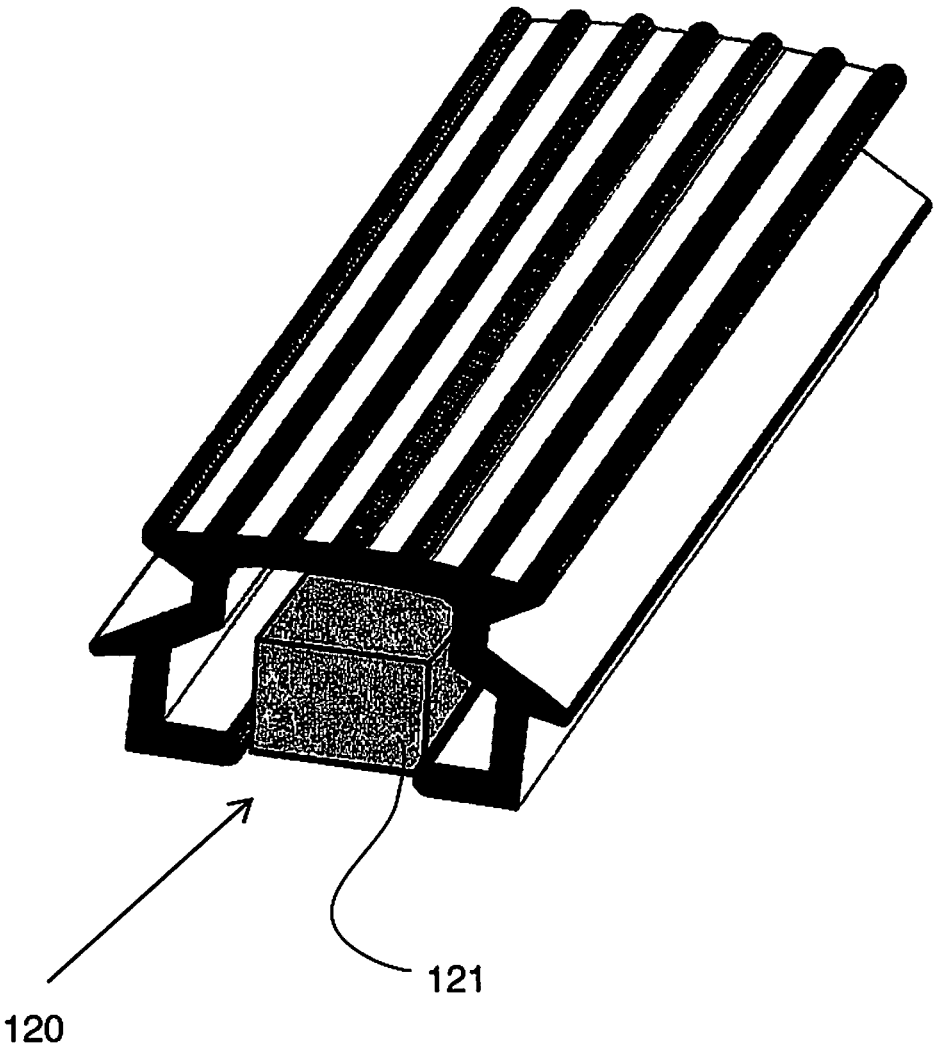
FIG. 3 is an isometric view of a rail portion of the barrier system with the installation aid shown, according to the present invention.
Figure 4:
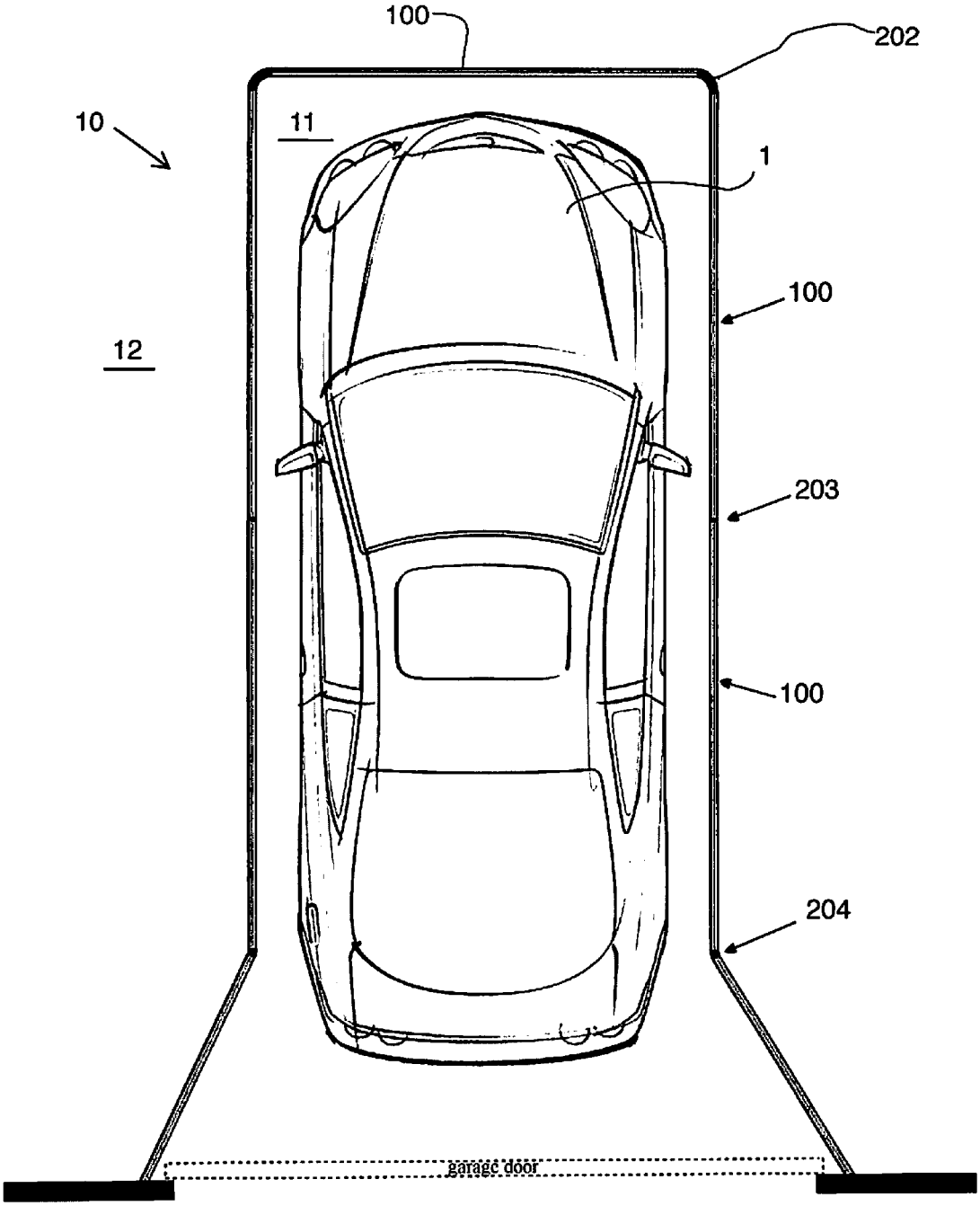
FIG. 4 is a top side view of the barrier system in use, according to the present invention.
Figure 5:
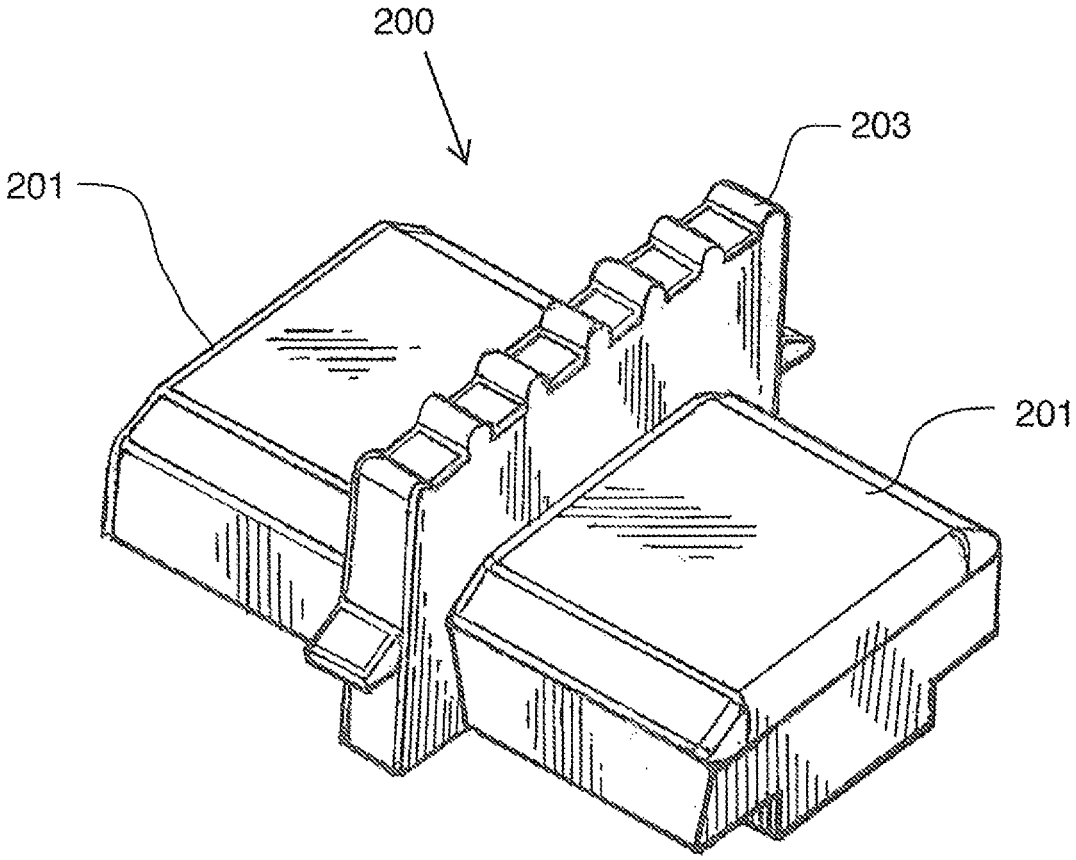
FIG. 5 is an isometric view of a straight connector, according to the present invention.
Figure 6:
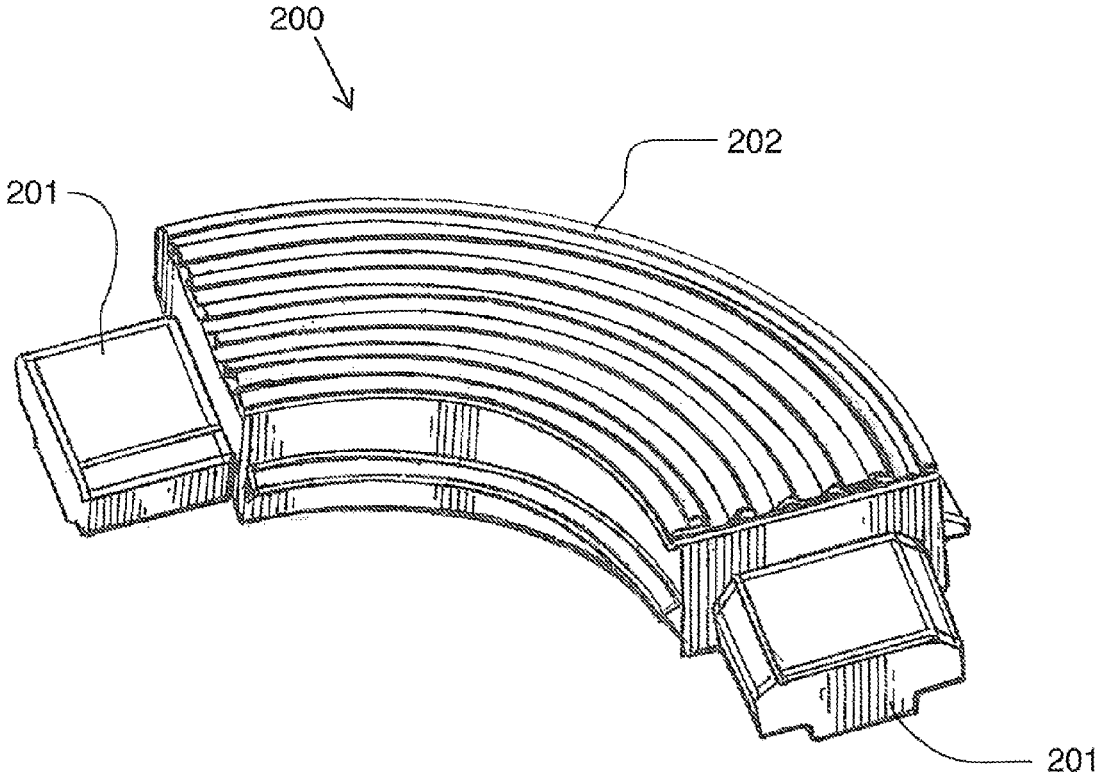
FIG. 6 is an isometric view of a corner connector, according to the present invention.
Figure 7:
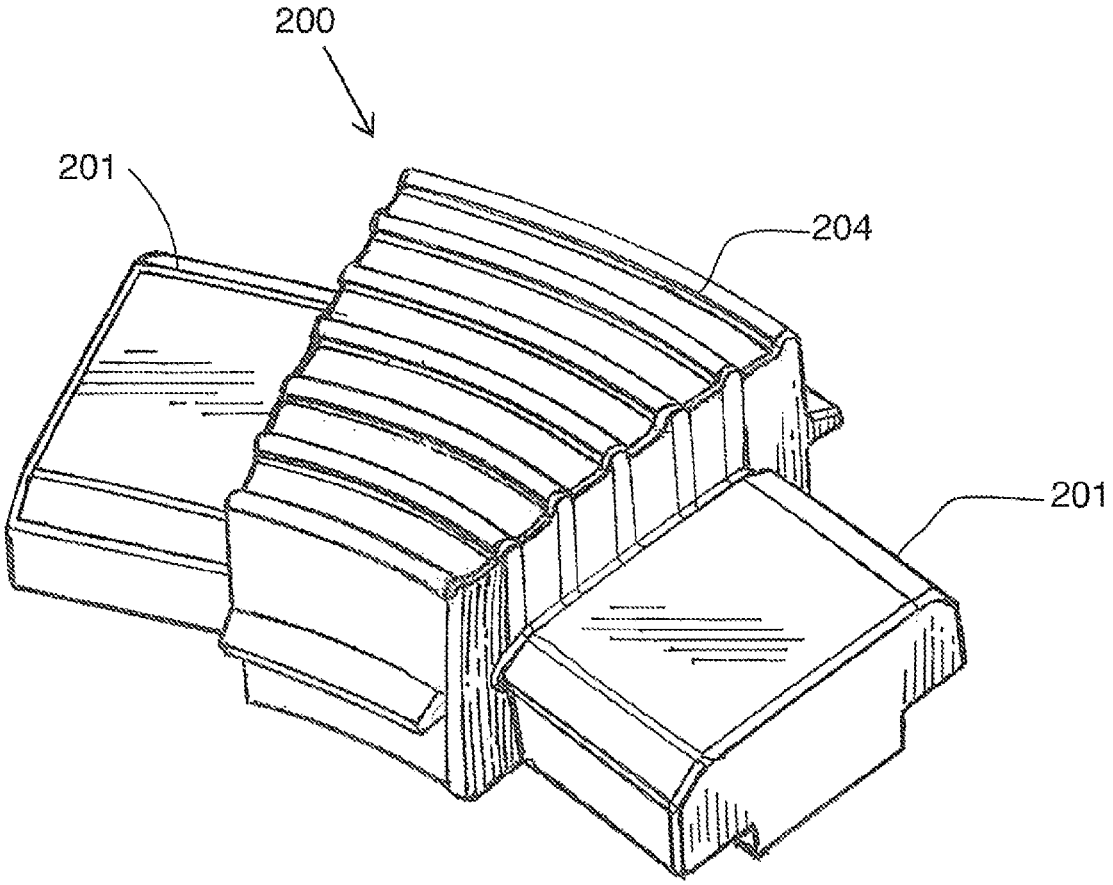
FIG. 7 is an isometric view of an angled connector, according to the present invention.
Figure 8:
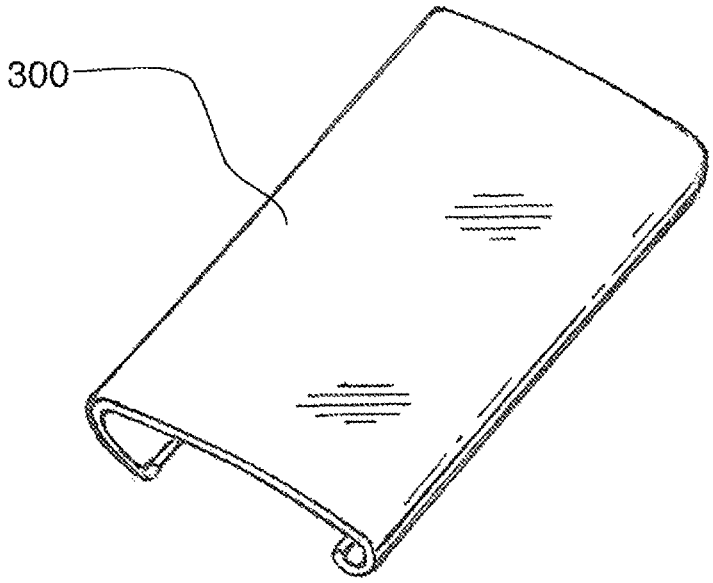
FIG. 8 is an isometric view of a cover member of the system, according to the present invention.
Figure 9:
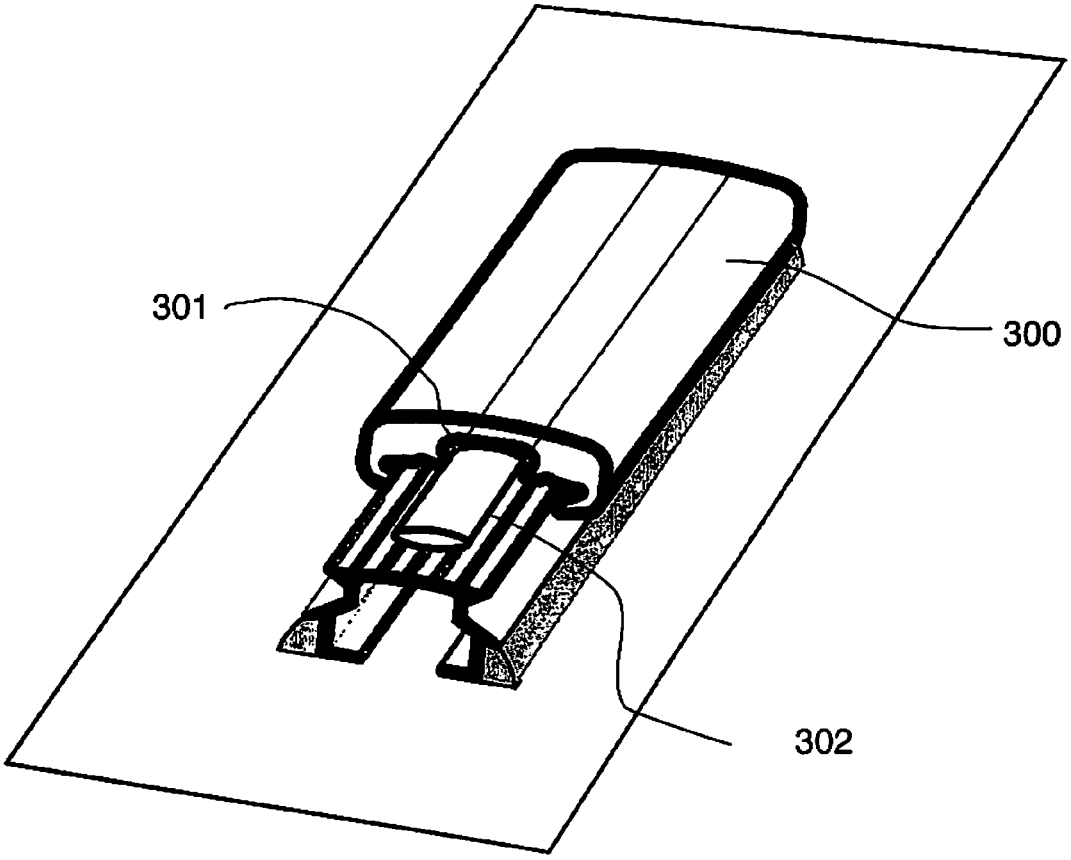
FIG. 9 is an isometric view of a clear cover member containing lights, according to the present invention.
Figure 10:
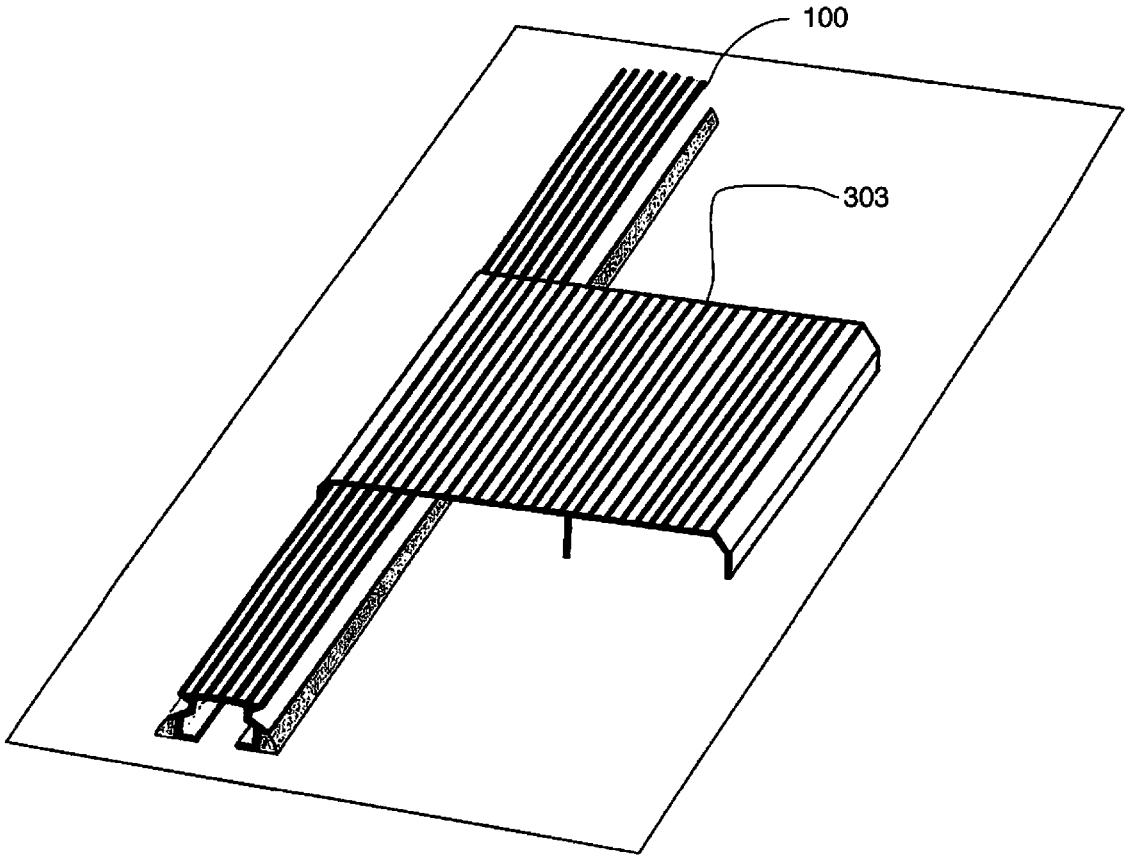
FIG. 10 is an isometric view of a step cover member, according to the present invention.
Figure 11:
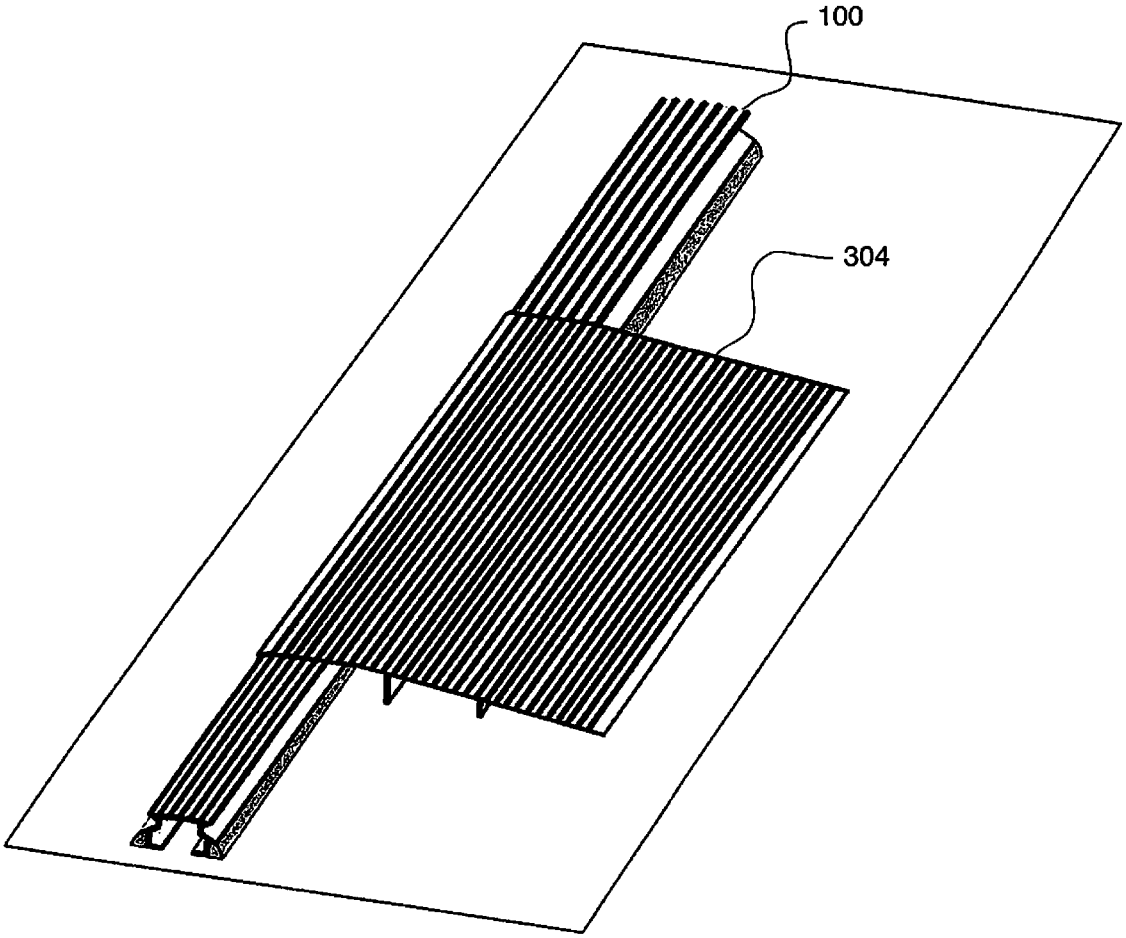
FIG. 11 is an isometric view of a ramp cover member, according to the present invention.
Figure 12:
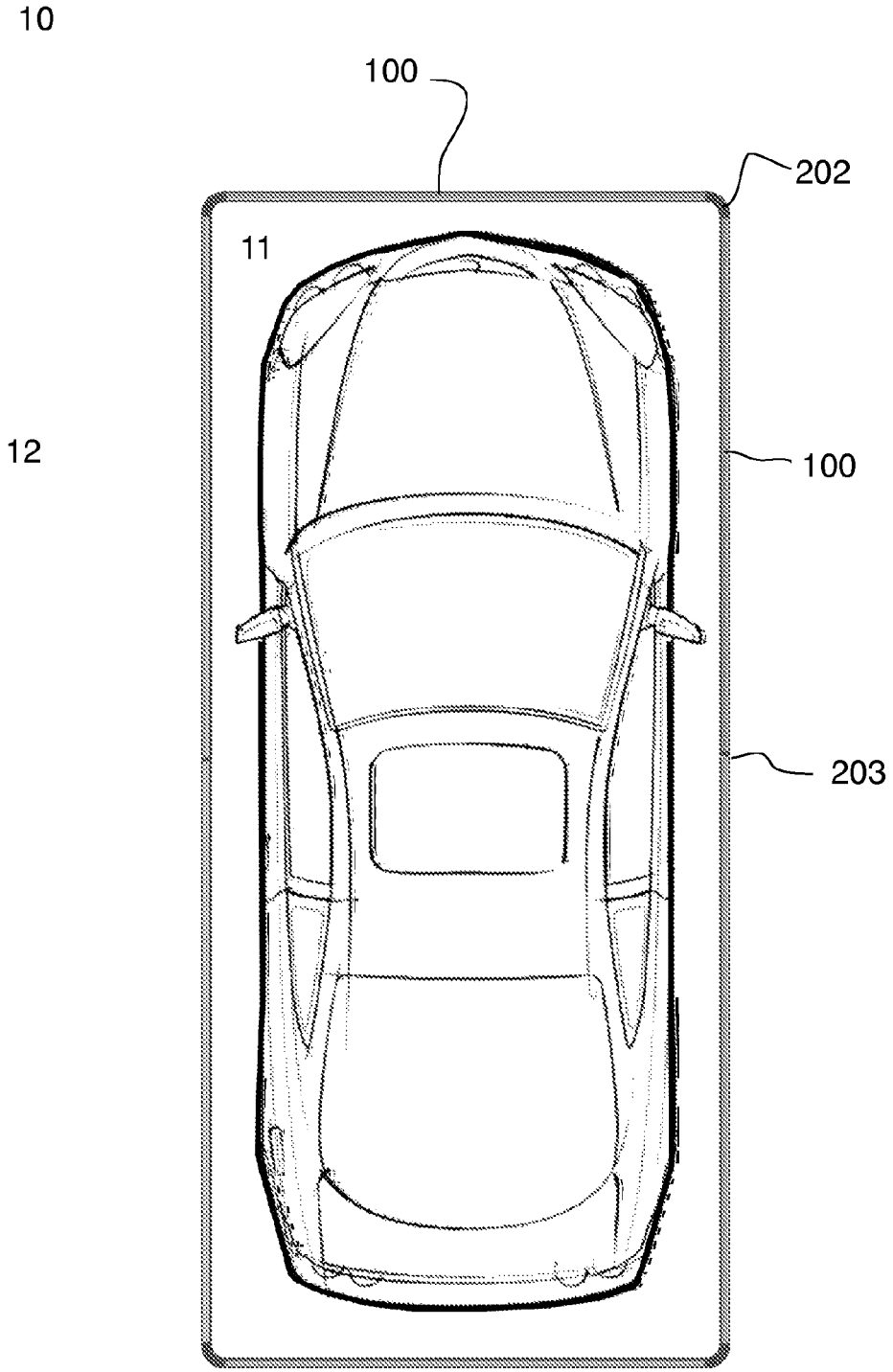
FIG. 12 is an alternate configuration of the barrier system in use, according to the present invention.

Referring now to FIGS. 1-12, a garage floor barrier system 10 for trapping debris is disclosed. The barrier system 10, in particular, is designed to trap within its interior perimeter 11 debris such as ice, snow, mud, slush, water, salt, road grime and other similar substances and segregate this debris from its exterior perimeter 12. The barrier system 10 comprises a plurality of uniformly configured rail portions 100 that are connected together to each other 100 with a plurality of connectors 202, 203, 204 to form a contiguous barrier and defining the interior 11 and exterior 12 of the barrier system 10. The barrier system 10 may be open to the exterior vehicle doorway of the garage or other structure (FIG. 4) or, alternatively, the barrier system may be in a closed configuration (FIG. 12) where an existing floor drain may be located within the enclosure and carry off the debris from the interior 11 of the barrier system.

Each rail portion 100 has a top side 101, a bottom side 102, and opposed sidewalls 103 defining an interior 104. The top side 101 includes an anti-skid portion 110, the anti skid portion 110 providing a gripping surface to create friction and prevent slippage if the surface is contacted by a user. In the preferred embodiment of the present invention, this anti-skid portion 110 is a series of raised ridges. These ridges create a smaller contact point and allow debris to fall into the valley of the ridges.

The top side 101 extends beyond its connection to the sidewalls 103, with this extension creating a lip portion 111. The lip portion 111 is angular extending downward from the top side 101 to the connection with the sidewall 103. This lip portion 111 forms an attachment surface allowing for the attachment of a cover member 300. The cover member 300 can be easily installed onto the top side 101 by snapping over and grasping the lip portion 111. The cover member 300 can be used to raise the height of the barrier system 10 to trap additional debris or can be installed in specific locations along the perimeter of the barrier system 10 to aid in ingress and egress of a vehicle 1. The cover member 300 may be provided in a translucent material and include a channel 301 for the placement of a strip light 302 or other similar lights or it may be used to provide customization by being provided in a multitude of colors.

When used as an aid for ingress and egress of the vehicle 1 the cover member 300 may be configured to form a step 303. The step 303 having a width and height and forming a platform for the placement of a user's foot during ingress or egress. The step will be removably attached to the rail portion 100 by grasping the lip portion 111 and can be moved to varying positions along the rail portion 100. In addition to a step 303, the cover member 200 may be configured to form a ramp 304 attached to the rail 100. The ramp 304 can be moved to varying positions along the rail portion 100. The ramp 304 allowing for the easy movement of objects over the raised height of the rail 100.

The bottom side 102 of the rail 100 contacts the surface of the floor and provides resting support for the rail portion 100. As is seen in cross section, the bottom side 102 includes a notch 120, the notch 120 sized to receive an installation aid 121 placed onto the surface of the floor. The installation aid 121 may be used to ensure proper alignment during installation, but it is not required for installation. Accordingly, the opposed sides of the notch 120 will straddle the installation aid 121, when used, and allow the user to install the barrier system 10 in the appropriate location by aligning the notch 120 with the installation aid 121. Preferably the installation aid 121 is an adhesive backed foam raised tape, although similar materials and mechanisms may be used.

The opposed side walls 103 are in communication with the top side 101 and bottom side 102 and form the sides of the barrier system 10. The side walls 103 extend downward from the top side 101 and form a recess 130. The recess 130 created from an outcropping 131 of the sidewall 103 and defining a height 132 from a lower portion of the outcropping 131 to the floor the barrier system 10 is installed on. The height 132 of the recess 130 corresponding to an appropriate bead size of an adhesive 133 applied to secure the barrier system 10 to the floor, wherein the adhesive 133 is applied using a standard or commercial caulking sized tube and tip. Accordingly, the configuration of the barrier system 10 side wall 103 provides for this recess 130 on both the interior 11 and exterior 12 of the barrier system 10 allowing for a double adhesive 133 seal along the barrier system interior and exterior side walls wherein both sides of the rail portion 100 are secured to the floor.

Preferably, the adhesive 133 used to secure the rail portions 100 and barrier system 10 to the floor is water penetrating adhesive to allow for installation on a damp surface. Although, this is the preferred adhesive type, there are other adhesive types that may be used to secure the system to the floor.

The connectors 200 are configured to attach adjacent sections of rail portion 100 by a fitting a connector end portion 201 for receipt within the hollow interior 104 of the rail portion 100. Accordingly, the connectors 200 have ends 201 sized and configured to the hollow interior 104 of the rail portion 100 for insertion during assembly. The connectors 200 are preferably constructed out of a durable plastic or rubber material and provided in varying positions to allow for customization during installation. Preferably, three angular positions are utilized to create individual connectors 200, these individual connectors 200 are: a corner connector 202, a straight connector 203, and an angled connector 204. The corner connector 202 is provided to form the corners of the barrier system 10 and utilized to create a near 90 degree bend in the assembly. The straight connector 203 is provided to attach two rail portions 100 approximately in line with each other end to end. The angled connector 204 is utilized to extend the barrier system 10 outward from an area around the vehicle to an area adjacent to the garage opening, wherein the angled 204 connector allows for a narrow width around the vehicle and wide width at the garage opening.

To install the garage floor barrier system 10 the user will clean the designated application area to remove any oil, dirt, and debris. In the event the installation is occurring on bare concrete floors, the surface of the concrete may be roughened by sanding or grinding to create a texture suitable for attachment by the adhesive. The user will then dry fit the barrier system 10 within the designated area to ensure proper component cut lengths and alignment. The user may then place the installation aid 121 on the flooring surface in the proper location and along the perimeter of the barrier system 10. The installation aid 121 does not need to be laid continuous but can be laid periodically to ensure proper alignment. The rail portion 100 and connectors 200 are then assembled in place by using the installation aid to ensure a proper fit. This is accomplished by placing the notch 120 of the rail portion bottom side 102 around the installation aid, wherein the installation aid 121 nests within the notch 120 and ensures a precise location of the rail portion 100 and barrier system 10.

After the barrier system 10 is assembled in the proper location, the user will then place an adhesive bead 133 within the recess 130 of the rail portion 100 along the barrier system 10 interior 11 and exterior 12 perimeters. This ensures that the barrier system 10 is water tight and secured to the flooring surface with the pair of recesses 130 allowing for a double seal. Upon completion of the installation, the user may then remove debris that become trapped within the barrier system 10 by using a broom, squeegee, pressure washer or other similar device to move the debris to the exterior of the structure.

In the preferred embodiment of the present invention, the rail portions 100 are constructed out of aluminum or plastic due to strength, durability, and corrosion resistance and shall be of sufficient strength and attached stability to allow for vehicles with rubber tires to roll over the rail without causing the rail to move, break, or become disconnected from the floor. Although aluminum or plastic materials are preferred, other similar and suitable materials of similar strength and corrosion resistance may be used. Preferably, the connectors 200 and cover member 300 are constructed out of rubber or plastic to allow for flexibility during assembly. The configuration of connectors 200 including shape and dimensions relative to the rail portion 100 allow for some flexibility of angle between adjacent connected rail portions 100.

Although the rail portion 100 and barrier system 10 can be constructed in a multitude of sizes and dimensions, the preferably dimensions are a width of 1 1/16 inch and a height of 5/8 of an inch. These dimensions are preferred for their ability to trap and segregate debris and remain unobtrusive to the user limiting any impediment to the movement of the user in and around the barrier system 10. Preferably, this barrier system 10 is configured closely around the partial perimeter of the vehicle and splays outward towards the garage opening or is configured closely around the full perimeter of the vehicle and encloses a floor drain along with the vehicle.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the specification and the drawings.

What is claimed is:

1. A barrier device for placement onto a flooring surface for the segregation of debris, the barrier device comprising:

a plurality of rail portions, the rail portions having:

a top side;

a bottom side opposite the top side, the bottom side providing resting support for the rail portion, the bottom side discontinuous and defining a notch;

a pair of opposed sidewalls, the pair of opposed sidewalls in communication with the top side and the bottom side, the top side extending beyond the sidewalls and forming a lip portion, the opposed sidewalls extending downward from the top side and forming an outcropping, the outcropping extending outward opposite the notch a distance beyond the lip and having a free edge configured to be spaced from the flooring surface and defining a recess positioned under the outcropping, the recess extending a height from the outcropping to the bottom side, the top side, bottom side, and opposed sidewalls defining an interior; and the lip portion angular and extending downward from the top side to the pair of opposed sidewalls, the lip portion forming an attachment surface;

a plurality of connectors, the connectors having a pair of opposed ends, the pair of opposed ends sides for receipt, within the interior of the rail portion, wherein the connectors secure adjacent rail portions together.

2. A device as in claim 1, wherein the top side includes an anti-skid surface, the anti-skid surface being a series of raised ridges.

3. A device as in claim 1, wherein the connectors are selected from the group of:

a straight connector;

an angled connector; and a corner connector, the corner connector providing for a near 90 degree bend.

4. A device as in claim 1, wherein the device includes a cover member, the cover member affixed to the lip, the cover member encompassing the top side and providing additional height.

5. A device as in claim 4, wherein the cover member is a step.

6. A device as in claim 4, wherein the cover member is a ramp.

7. A device as in claim 4, wherein the cover member carries a strip light.

8. A device as in claim 1, wherein the recess is sized to receive a bead of adhesive.

9. A device as in claim 1, wherein the notch is sized for the receipt of an installation aid, the installation aid affixed to the flooring surface.

10. A device as in claim 9, wherein the installation aid is a raised foam tape.

11. A device as in claim 1, wherein the rail portion has a height of ⅝ of an inch and a width of 1-1/16 inch.

12. A barrier device for placement onto a garage flooring surface for the segregation of debris, the barrier device comprising:

a plurality of rail portions, the rail portions having:

a top side, the top side having an anti-skid portion, the anti-skid portion comprised of a series of raised ridges;

a bottom side opposite the top side, the bottom side providing resting support for the rail portion, the bottom side discontinuous and defining a notch, the notch sized for the receipt of a installation aid, the installation aid being a raised foam tape and affixed to the flooring surface;

a pair of opposed sidewalls, the pair of opposed sidewalls in communication with the top side and the bottom side, the top side extending beyond the sidewalls and forming a lip portion, the opposed sidewalls extending downward from the top side and forming an outcropping, the outcropping extending outward opposite the notch a distance beyond the lip and having a free edge configured to be spaced from the flooring surface and defining a recess positioned under the outcropping, the recess extending a height from the outcropping to the bottom side, the recess sized to receive a bead of adhesive, the top side, bottom side, and opposed sidewalls defining an interior; and the lip portion angular and extending downward from the top side to the pair of opposed sidewalls, the lip portion forming an attachment surface for a cover, the cover designed for removable placement on the top side;

a plurality of connectors, the connectors having a pair of opposed ends, the pair of opposed ends sides for receipt, within the interior of the rail portion, wherein the connectors secure adjacent rail portions together.

13. A device as in claim 12, wherein the connectors are selected from the group of:

a straight connector;

an angled connector; and a corner connector, the corner connector providing for a near 90 degree bend.

14. A device as in claim 12, wherein the cover member is a step.

15. A device as in claim 12, wherein the cover member is a ramp.

16. A device as in claim 12, wherein the cover member carries a strip light.

17. A device as in claim 12, wherein the rail portion has a height of ⅝ of an inch and a width of 1 inch.

* * * * *